US007443377B2

(12) United States Patent
Kim

(10) Patent No.: US 7,443,377 B2
(45) Date of Patent: Oct. 28, 2008

(54) METHOD AND APPARATUS FOR DRIVING LIQUID CRYSTAL DISPLAY

(75) Inventor: Ki Duk Kim, Gunpo-shi (KR)

(73) Assignee: LG Display Co., Ltd., Seoul (KR)

( * ) Notice: Subject to any disclaimer, the term of this patent is extended or adjusted under 35 U.S.C. 154(b) by 684 days.

(21) Appl. No.: 10/879,868

(22) Filed: Jun. 28, 2004

(65) Prior Publication Data

US 2005/0219179 A1 Oct. 6, 2005

(30) Foreign Application Priority Data

Dec. 22, 2003 (KR) ..... 10-2003-0094974

(51) Int. Cl.
*G09G 3/36* (2006.01)

(52) U.S. Cl. ..... 345/102; 345/88

(58) Field of Classification Search ..... 345/87, 345/88, 89, 101, 102, 204
See application file for complete search history.

(56) References Cited

U.S. PATENT DOCUMENTS 6,762,742 B2 * 7/2004 Moon et al. ..... 345/102
6,795,053 B1 * 9/2004 Funamoto et al. ..... 345/102

* cited by examiner

*Primary Examiner*—Richard Hjerpe
*Assistant Examiner*—Tom V Sheng
(74) *Attorney, Agent, or Firm*—Brinks Hofer Gilson & Lione

(57) ABSTRACT

A driving method and apparatus for a liquid crystal display is disclosed in which the contrast ratio of data to be displayed is expanded and brightness of a back light is selectively changed in correspondence with the data. Whether the data is that of an initial color field is determined. The data is converted into brightness components and arranged into a histogram for each frame. Data having an expanded contrast is generated by the histogram. A control value is extracted from the histogram. The brightness of the back light is generated in correspondence with the control value if an initial color field is not displayed. However, if an initial color field is displayed, a predetermined brightness is supplied irrespective of the extracted control value.

49 Claims, 11 Drawing Sheets

Y HISTOGRAM

METHOD AND APPARATUS FOR DRIVING LIQUID CRYSTAL DISPLAY

PRIORITY CLAIM

This application claims the benefit of Korean Patent Application No. P2003-94974 filed in Korea on Dec. 22, 2003, which is hereby incorporated by reference.

BACKGROUND OF THE INVENTION

1. Field of the Invention

This invention relates to a liquid crystal display, and more particularly to a driving method and apparatus for a liquid crystal display in which the contrast ratio of the data can be expanded and brightness of a back light can be selectively changed in correspondence with the data.

2. Description of the Related Art

Generally, a liquid crystal display (LCD) controls light transmittance of liquid crystal cells in accordance with video signals to thereby display a picture. Such an LCD has been implemented by an active matrix type having a switching device for each cell, and applied to a display device such as computer monitors, office equipment, and cellular phones. The switching device for the active matrix LCD mainly employs a thin film transistor (TFT).

FIG. 1 schematically shows a conventional LCD driving apparatus.

Referring to FIG. 1, the conventional LCD driving apparatus includes a liquid crystal display panel 2 having m×n liquid crystal cells Clc arranged in a matrix type, m data lines D1 to Dm and n gate lines G1 to Gn intersecting each other and thin film transistors TFT provided at the intersections, a data driver 4 for applying data signals to the data lines D1 to Dm of the liquid crystal display panel 2, a gate driver 6 for applying scanning signals to the gate lines G1 to Gn, a gamma voltage supplier 8 for supplying the data driver 4 with gamma voltages, a timing controller 10 for controlling the data driver 4 and the gate driver 6 using synchronizing signals from a system 20, a direct current to direct current converter 14, hereinafter referred to as "DC/DC converter", for generating voltages supplied to the liquid crystal display panel 2 using a voltage from a power supply 12, and an inverter 16 for driving a back light 18.

The system 20 applies vertical/horizontal signals Vsync and Hsync, clock signals DCLK, a data enable signal DE and data R, G and B to the timing controller 10.

The liquid crystal display panel 2 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 8 applies a plurality of gamma voltages to the data driver 4.

The data driver 4 converts digital video data R, G and B into analog gamma voltages (i.e., data signals) corresponding to gray level values in response to a control signal CS from the timing controller 10, and applies the analog gamma voltages to the data lines D1 to Dm.

The gate driver 6 sequentially applies a scanning pulse to the gate lines G1 to Gn in response to a control signal CS from the timing controller 10 to thereby select horizontal lines of the liquid crystal display panel 2 supplied with the data signals.

The timing controller 10 generates the control signals CS for controlling the gate driver 6 and the data driver 4 using the vertical/horizontal synchronizing signals Vsync and Hsync and the clock signal DCLK inputted from the system 20. Herein, the control signal CS for controlling the gate driver 6 is comprised of a gate start pulse GSP, a gate shift clock GSC and a gate output enable signal GOE, etc. Further, the control signal CS for controlling the data driver 4 is comprised of a source start pulse SSP, a source shift clock SSC, a source output enable signal SOE and a polarity signal POL, etc. The timing controller 10 re-aligns the data R, G and B from the system 20 to apply them to the data driver 4.

The DC/DC converter 14 boosts or drops a voltage of 3.3V inputted from the power supply 12 to generate a voltage supplied to the liquid crystal display panel 2. Such a DC/DC converter 14 generates a gamma reference voltage, a gate high voltage VGH, a gate low voltage VGL and a common voltage Vcom, etc.

The inverter 16 applies a driving voltage (or driving current) for driving the back light 18 to the back light 18. The back light 18 generates a light corresponding to the driving voltage (or driving current) from the inverter 16 to apply it to the liquid crystal display panel 2.

In order to display a vivid image on the liquid crystal display panel 2 driven in this manner, a distinct contrast between brightness and darkness must be made in correspondence with data to be displayed. However, since the conventional back light 18 produces a constant degree of brightness irrespectively of the data, it is difficult to display a dynamic and fresh image.

SUMMARY OF THE INVENTION

Aspects of the present invention provide a driving method and apparatus for a liquid crystal display in which the contrast ratio of the data to be displayed can be expanded and brightness of a back light can be selectively changed in correspondence with the data.

A method of driving a display according to one aspect of the present invention includes (A) determining whether data to be displayed is that of an initial color field; and (B) controlling a back light such that a predetermined brightness is supplied when the data is that of the initial color field.

A method of driving a frame of a display according to a second aspect of the present invention includes (A) determining whether first data to be displayed is that of an initial color field; (B) converting the first data into brightness components and arranging the brightness components into a histogram; (C) generating second data having an expanded contrast using the histogram; (D) extracting a control value from the histogram; and (E) controlling brightness of a back light in correspondence with the control value if it is determined that the first data is not that of the initial color field, and controlling the back light to emit a predetermined brightness irrespective of the control value if it is determined that the first data is that of the initial color field.

A method of driving a display according to a third aspect of the present invention includes determining whether an image to be displayed on the display is substantially a single color; determining a control value from a brightness of the image; expanding a contrast of the image using the control value; controlling a back light to emit light of a brightness independent of the control value if the image is substantially the single color and using the control value if the image is not substantially the single color; and displaying the image of expanded contrast using light from the back light.

A driving apparatus for a display according to an aspect of the present invention includes: an initial color determiner that determines whether first data received at an input is an initial color field; an image signal modulator that extracts brightness components from the first data, converts the brightness components into a histogram for each frame, and generates second data having an expanded contrast in correspondence with a result extracted from the histogram; a back light that emits light; and a back light controller that controls brightness of the back light under control of the initial color determiner or the image signal modulator dependent on whether the first data is the initial color field.

BRIEF DESCRIPTION OF THE DRAWINGS

Embodiments of the invention will be apparent from the following detailed description of the embodiments of the present invention with reference to the accompanying drawings, in which.

DETAILED DESCRIPTION OF THE PREFERRED EMBODIMENT

Figure 1:
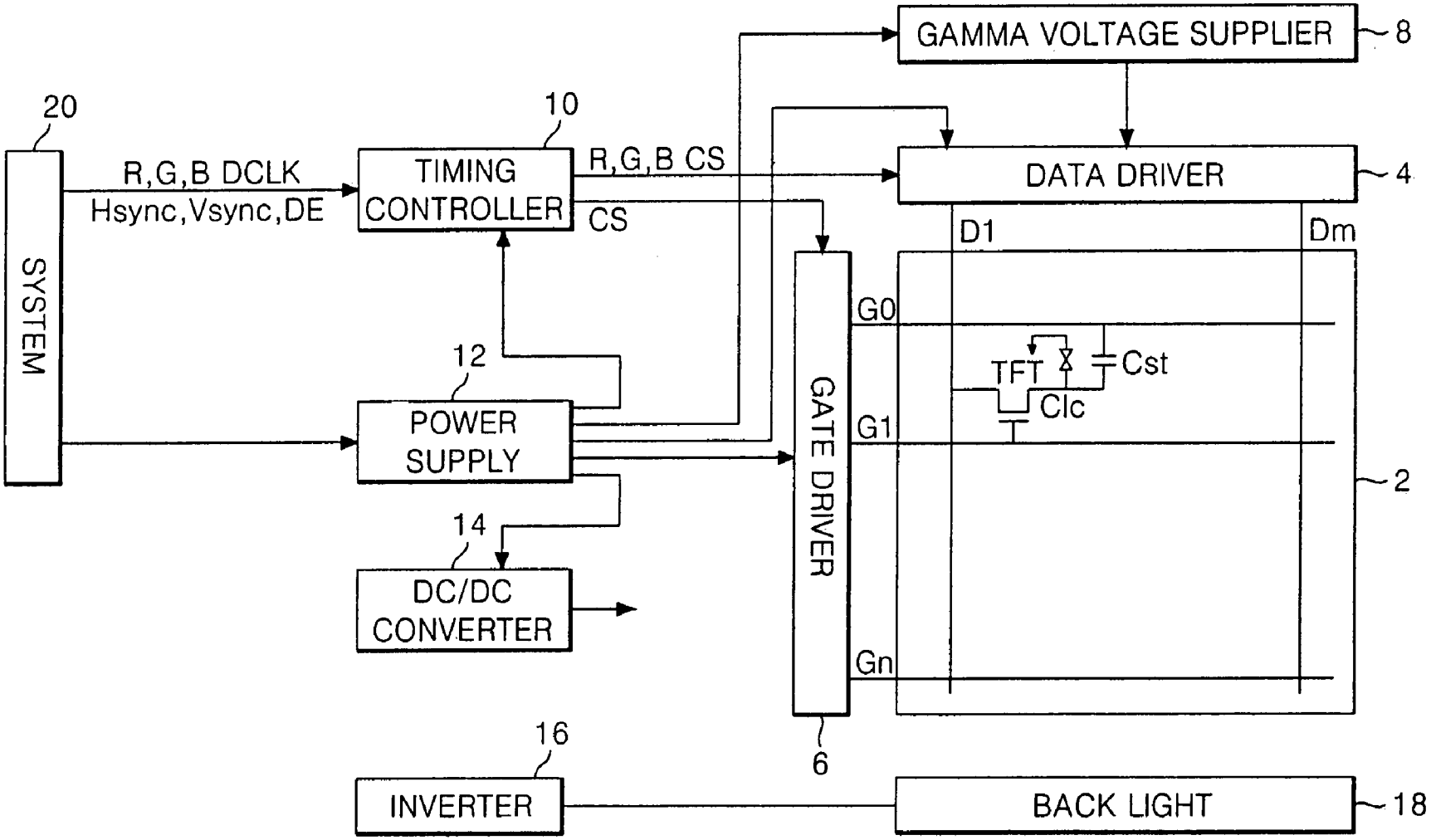
FIG. 1 RELATED ART
FIG. 1 is a schematic block diagram showing a configuration of a conventional driving apparatus for a liquid crystal display.
Figure 2:
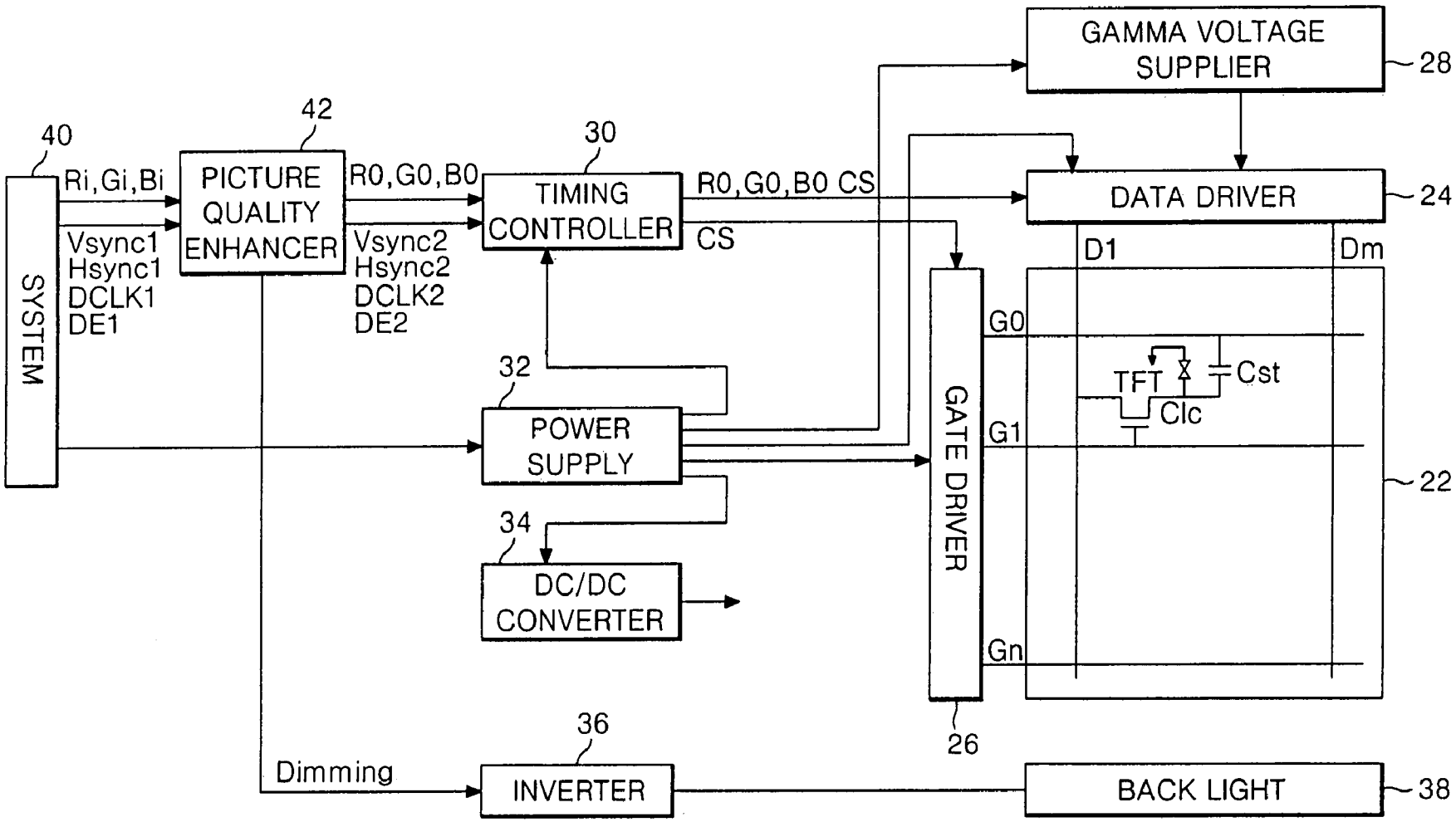
FIG. 2 is a schematic block diagram showing a configuration of a driving apparatus for a liquid crystal display according to an embodiment of the present invention.

FIG. 2 schematically shows a driving apparatus for a liquid crystal display (LCD) according to an embodiment of the present invention.

Referring to FIG. 2, the LCD driving apparatus according to the embodiment of the present invention includes a liquid crystal display panel 22 having m×n liquid crystal cells Clc arranged in a matrix type, m data lines D1 to Dm and n gate lines G1 to Gn intersecting each other and thin film transistors TFT provided at the intersections, a data driver 24 for applying data signals to the data lines D1 to Dm of the liquid crystal display panel 22, a gate driver 26 for applying scanning signals to the gate lines G1 to Gn, a gamma voltage supplier 28 for supplying the data driver 24 with gamma voltages, a timing controller 30 for controlling the data driver 24 and the gate driver 26 using a second synchronizing signal from a picture quality enhancer 42, a DC/DC converter 34 for generating voltages supplied to the liquid crystal display panel 22 using a voltage from a power supply 32, an inverter 36 for driving a back light unit 38, and a picture quality enhancer 42 for selectively emphasizing a contrast of input data and for applying a brightness control signal Dimming corresponding to the input data to the inverter 36.

The system 40 applies first vertical/horizontal signals Vsync1 and Hsync1, a first clock signal DCLK1, a first data enable signal DE1 and first data Ri, Gi and Bi to the picture quality enhancer 42.

The liquid crystal display panel 22 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 28 applies a plurality of gamma voltages to the data driver 24.

The data driver 24 converts digital video data Ro, Go and Bo into analog gamma voltages (i.e., data signals) corresponding to gray level values in response to a control signal CS from the timing controller 30, and applies the analog gamma voltages to the data lines D1 to Dm.

The gate driver 26 sequentially applies a scanning pulse to the gate lines G1 to Gn in response to a control signal CS from the timing controller 30 to thereby select horizontal lines of the liquid crystal display panel 22 supplied with the data signals.

The timing controller 30 generates the control signals CS for controlling the gate driver 26 and the data driver 24 using second vertical/horizontal synchronizing signals Vsync2 and Hsync2 and a second clock signal DCLK2 inputted from the picture quality enhancer 42. Herein, the control signal CS for controlling the gate driver 26 is comprised of a gate start pulse GSP, a gate shift clock GSC and a gate output enable signal GOE, etc. Further, the control signal CS for controlling the data driver 24 is comprised of a source start pulse SSP, a source shift clock SSC, a source output enable signal SOE and a polarity signal POL, etc. The timing controller 30 re-aligns second data Ro, Go and Bo from the picture quality enhancer 42 to apply them to the data driver 24.

The DC/DC converter 34 boosts or drops a voltage of 3.3V inputted from the power supply 32 to generate a voltage supplied to the liquid crystal display panel 22. Such a DC/DC converter 14 generates a gamma reference voltage, a gate high voltage VGH, a gate low voltage VGL and a common voltage Vcom.

The inverter 36 applies a driving voltage (or driving current) corresponding to the brightness control signal Dimming from the picture quality enhancer 42 to the back light 38. In other words, a driving voltage (or driving current) applied from the inverter 36 to the back light 38 is determined by the brightness control signal Dimming from the picture quality enhancer 42. The back light 38 applies light corresponding to the driving voltage (or driving current) from the inverter 36 to the liquid crystal display panel 22.

The picture quality enhancer 42 extracts brightness components for each frame using the first data Ri, Gi and Bi from the system 40, and generates second data Ro, Go and Bo obtained by a change in gray level values of the first data Ri, Gi and Bi in correspondence with the extracted brightness components for each frame. In this case, the picture quality enhancer 42 generates the second data Ro, Go and Bo such that a contrast is expanded with respect to the input data Ri, Gi and Bi.

Further, the picture quality enhancer 42 generates a brightness control signal Dimming corresponding to brightness components to apply it to the inverter 36. The picture quality enhancer 42 extracts a control value capable of controlling the back light, for example, a most-frequent value (i.e., the gray level that has the greatest occupancy in the histogram) and/or an average value (i.e., the average value of the gray levels in the histogram) from the brightness components, and generates the brightness control signal Dimming using the extracted control value. The picture quality enhancer 42 divides brightness of the back light corresponding to gray levels of the brightness components into at least two regions, and generates the brightness control signal Dimming selected in correspondence with the control value.

Moreover, the picture quality enhancer 42 generates second vertical/horizontal synchronizing signals Vsync2 and Hsync2, a second clock signal DCLK2 and a second data enable signal DE2 synchronized with the second data Ro, Go and Bo with the aid of the first vertical/horizontal synchronizing signals Vsync1 and Hsync1, the first clock signal DCLK1 and the first data enable signal DE1 inputted from the system 40.

Figure 3:
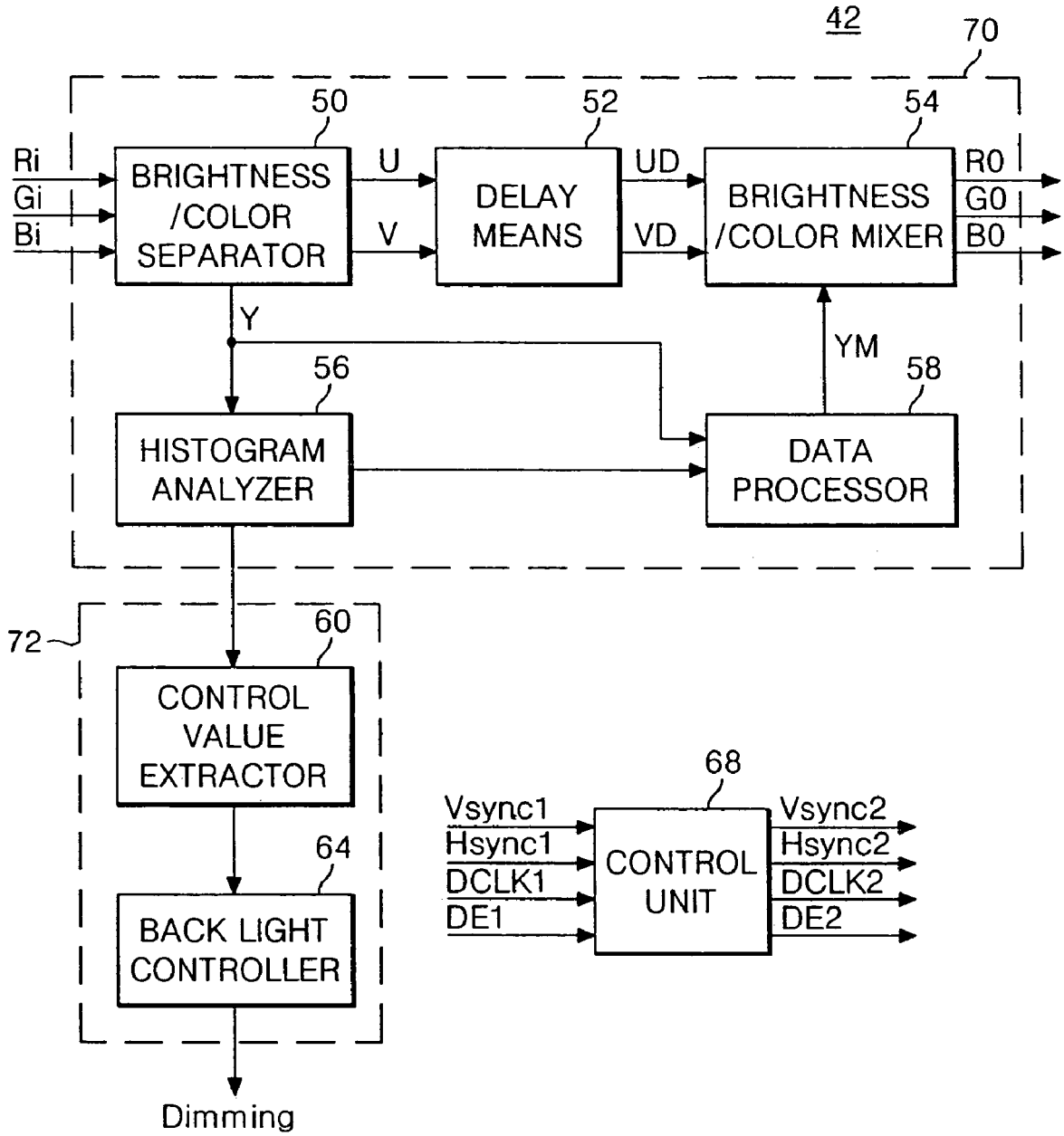
FIG. 3 is a block diagram of a first embodiment of the picture quality enhancer shown in FIG. 2.

To this end, as shown in FIG. 3, the picture quality enhancer 42 includes an image signal modulator 70 for generating the second data Ro, Go and Bo using the first data Ri, Gi and Bi, a back light control 72 for generating the brightness control signal Dimming under control of the image signal modulator 70, and a control unit 68 for generating the second vertical/horizontal synchronizing signals Vsync2 and Hsync2, the second clock signal DCLK2 and the second enable signal DE2.

The image signal modulator 70 extracts brightness components Y from the first data Ri, Gi and Bi, and generates second data Ro, Go and Bo in which a contrast is partially emphasized with the aid of the extracted brightness components Y. To this end, the image signal modulator 70 includes a brightness/color separator 50, a delay 52, a brightness/color mixer 54, a histogram analyzer 56 and a data processor 58.

The brightness/color separator 50 separates the first data Ri, Gi and Bi into brightness components Y and chrominance components U and V. The brightness components Y and the chrominance components U and V are obtained by the following equations:

$$Y=0.229\times Ri+0.587\times Gi+0.114\times Bi \quad (1)$$

$$U=0.493\times(Bi-Y) \quad (2)$$

$$V=0.887\times(Ri-Y) \quad (3)$$

Figure 4:
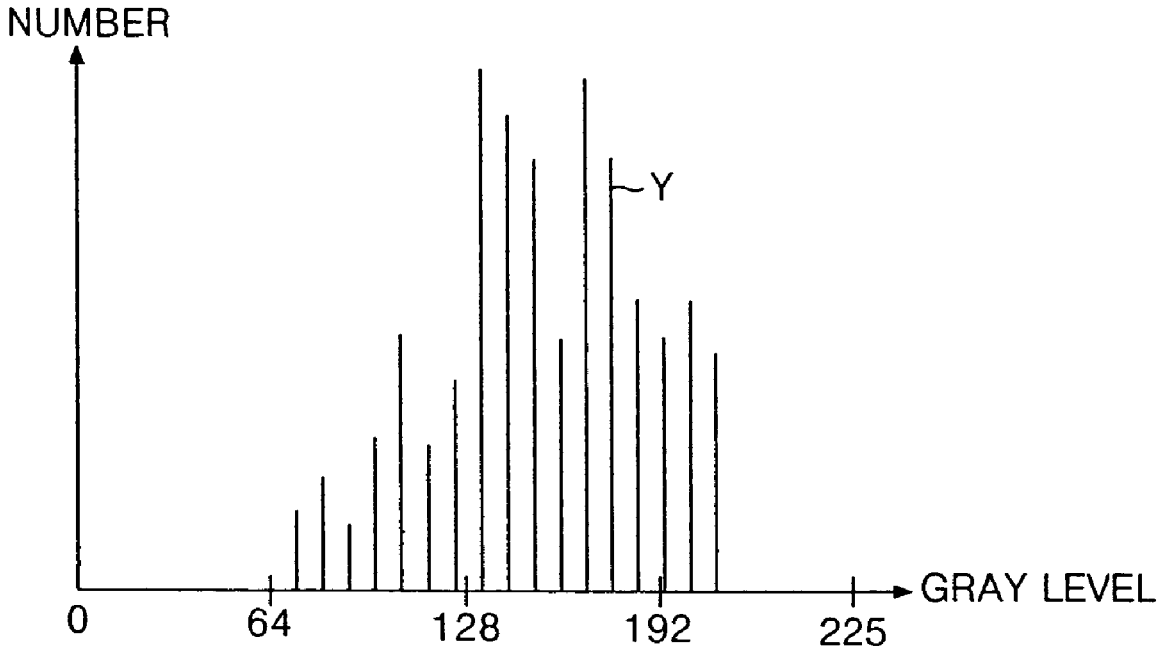
FIG. 4 is a graph showing an example of a histogram analyzed by the histogram analyzer shown in FIG. 3.

The histogram analyzer 56 divides the brightness components Y into gray levels for each frame. In other words, the histogram analyzer 56 arranges the brightness components Y for each frame to correspond to the gray levels, thereby obtaining a histogram as shown in FIG. 4. The shape of the histogram varies dependent on the brightness components of the first data Ri, Gi and Bi.

The data processor 58 generates modulated brightness components YM having an emphasized contrast using the analyzed histogram from the histogram analyzer 56. The data processor 58 generates modulated brightness components YM by various methods such as those disclosed in Korean Patent Applications Nos. 2003-036289, 2003-040127, 2003-041127, 2003-80177, 2003-81171, 2003-81172, 2003-81173 and 2003-81175, previously filed by the Applicants, and which are herein incorporated by reference.

The delay 52 delays chrominance components U and V until the brightness components YM modulated by the data processor 58 are produced. Further, the delay 52 applies the delayed chrominance components VD and UD to the brightness/color mixer 54 to be synchronized with the modulated brightness components YM.

The brightness/color mixer 54 generates second data Ro, Go and Bo with the aid of the modulated brightness components YM and the delayed chrominance components UD and VD. The second data Ro, Go and Bo is obtained by the following equations:

$$Ro=YM+0.000\times UD+1.140\times VD \quad (4)$$

$$Go=YM-0.396\times UD-0.581\times VD \quad (5)$$

$$Bo=YM+2.029\times UD+0.000\times VD \quad (6)$$

Since the second data Ro, Go and Bo obtained by the brightness/color mixer 54 has been produced from the modulated brightness components YM having an expanded contrast, they have an expanded contrast compared to that of the first data Ri, Gi and Bi. The second data Ro, Go and Bo are applied to the timing controller 30.

The control unit 68 receives the first vertical/horizontal synchronizing signals Vsync1 and Hsync1, the first clock signal DCLK1 and the first data enable signal DE1 from the system 40. Further, the controller 68 generates the second vertical/horizontal synchronizing signals Vsync2 and Hsync2, the second clock signal DCLK2 and the second data enable signal DE2 to be synchronized with the second data Ro, Go and Bo, and applies them to the timing controller 30.

The back light control 72 extracts a control value from the histogram analyzer 56, and generates a brightness control signal Dimming using the extracted control value. The control value is variable and permits the brightness of the back light 38 to be changed. For instance, as above, the control value can be the most-frequent value and/or the average value of the histogram.

The back light control 72 includes a control value extractor 60 and a back light controller 64.

Figure 5:
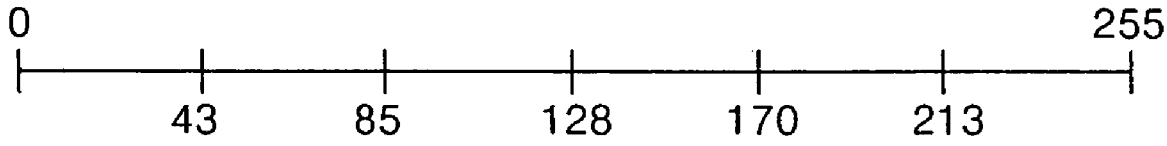
FIG. 5 depicts a plurality of areas divided for the purpose of controlling brightness of the back light by the back light controller shown in FIG. 3.

As shown in FIG. 5, the back light controller 64 divides gray levels of the brightness components Y into a plurality of areas, and controls the back light 38 such that a different brightness is supplied for each area. In other words, the back light controller 64 determines the gray level of the control value, and generates a brightness control signal Dimming to correspond to an area to which the control value belongs.

The control value extractor 60 extracts a control value from the histogram analyzer 56 to apply it to the back light controller 64.

An operation procedure of the back light control 72 will be described in detail below.

First, the control value extractor 60 extracts a control value from a histogram analyzed by the histogram analyzer 56 to apply it to the back light controller 64. The back light controller 64 having received the control value checks the area (i.e., gray level value) to which a control value applied thereto belongs of a plurality of divided gray level values as shown in FIG. 5, and generates a brightness control signal Dimming corresponding thereto.

The brightness control signal Dimming from the back light controller 64 is applied to the inverter 36. The inverter 36 controls the back light 38 in response to the brightness control signal Dimming, thereby applying light corresponding to the brightness control signal Dimming to the liquid crystal display panel 22.

Accordingly, the present embodiment generates the second data Ro, Go and Bo having an expanded contrast in correspondence with the brightness components Y for one frame of the first data Ri, Gi and Bi, thereby displaying a vivid image. Furthermore, the present embodiment controls brightness of the back light 38 in correspondence with the brightness components Y for one frame of the first data Ri, Gi and Bi, thereby displaying a vivid image.

Figure 6A:
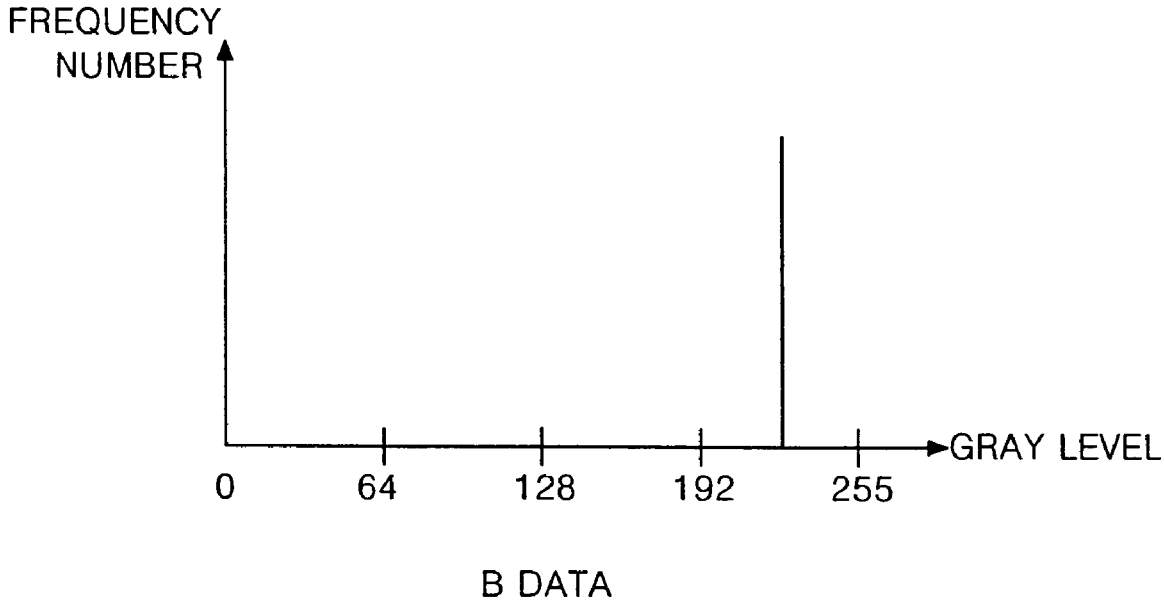
FIG. 6A and FIG. 6B are graphs showing gray levels when a blue data has been changed into brightness components.
Figure 6B:
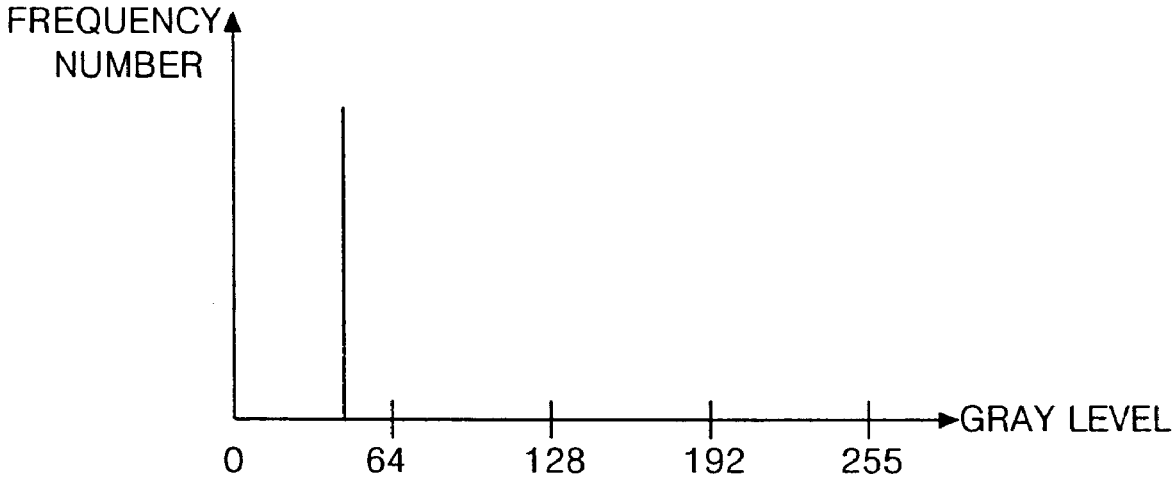

However, in the embodiment above, the brightness is not determined accurately when an initial image having red(R), green(G) or blue(B) only is displayed. For instance, when the frame consists of a blue field, it is determined to be a dark field by equation (1) corresponding to a brightness component Y of 0.114. Accordingly, a relatively low brightness is applied by the back light 38. However, even if a single colored blue image of a high brightness, as shown in the blue data of FIG. 6A, is supposed to be shown, the frame is determined to have small brightness components as shown in FIG. 6B. Thus, a problem exists due to the separation between the brightness of the back light and the brightness of individual colors, especially when one color dominates the display. In other words, when an initial image is displayed, the desired color may not be restored due to deterioration in the brightness.

Figure 7:
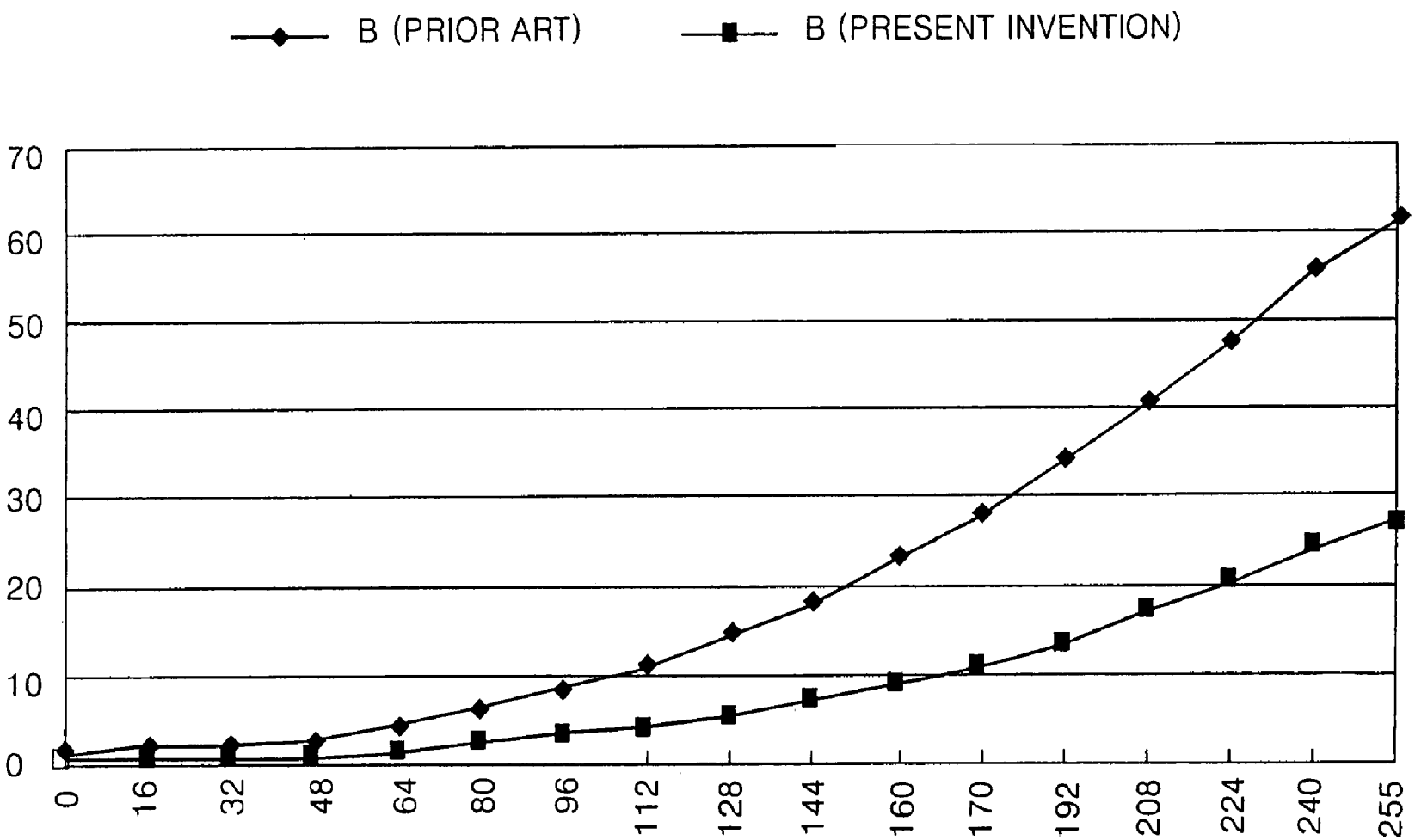
FIG. 7 illustrates brightness of a blue data that is changed into brightness components to display it.

In the present embodiment shown in FIG. 3, when a blue (B) image is displayed, an image having brightness lower than the prior art is displayed as shown in FIG. 7. In FIG. 7, X axis represents gray levels and Y axis represents brightness.

Likewise, the present embodiment has a problem in that, when red (R) and green (G) initial images are displayed, the brightness cannot be controlled accurately and thus the ability of the LCD to restore the color is deteriorated.

Figure 8:
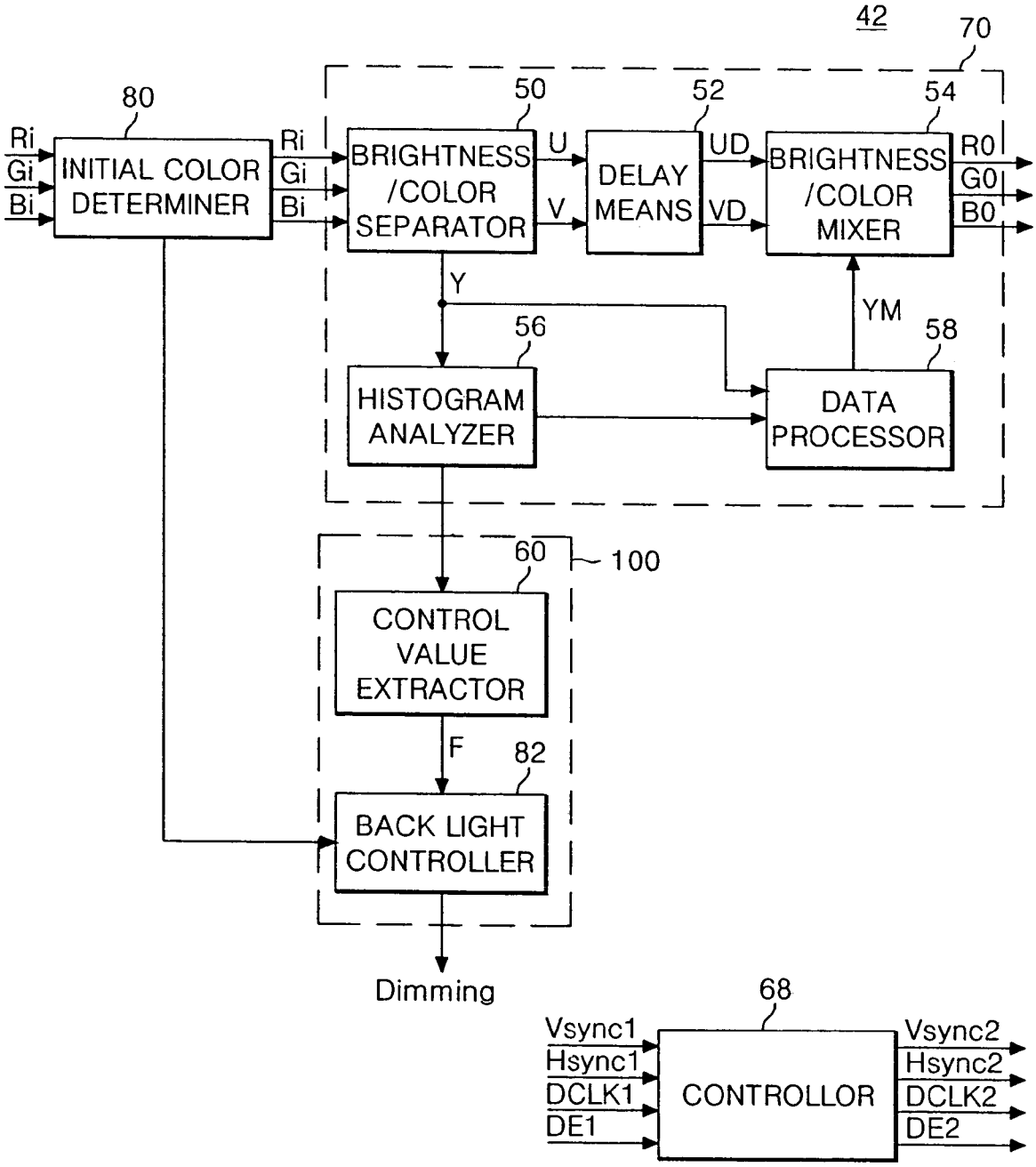
FIG. 8 is a block diagram of a second embodiment of the picture quality enhancer shown in FIG. 2.

FIG. 8 shows a picture quality enhancer 42 according to another embodiment of the present invention which overcomes this problem. Blocks in FIG. 8 having the same function as those in FIG. 3 are assigned the same reference numerals and described briefly.

Referring to FIG. 8, the picture quality enhancer 42 includes an initial color determiner 80 for determining whether or not the first data Ri, Gi and Bi are display an initial color image, an image signal modulator 70 for generating the second data Ro, Go and Bo using the first data Ri, Gi and Bi inputted from the initial color determiner 80, a back light control 100 for generating the brightness control signal Dimming under control of the image signal modulator 70 and the initial color determiner 80, and a control unit 68 for generating the second vertical/horizontal synchronizing signals Vsync2 and Hsync2, the second clock signal DCLK2 and the second enable signal DE2.

The brightness/color separator 50 of the image signal modulator 70 separates the first data Ri, Gi and Bi into brightness components Y and chrominance components U and V. The histogram analyzer 56 arranges the brightness components Y for each frame to correspond to the gray levels, thereby obtaining a histogram. The data processor 58 generates modulated brightness components YM having an emphasized contrast using the analyzed histogram from the histogram analyzer 56. The delay 52 delays chrominance components U and V such that the modulated brightness components YM can be produced from the data processor 58. The brightness/color mixer 54 generates second data Ro, Go and Bo with the aid of the modulated brightness components YM and the delayed chrominance components UD and VD. Since the second data Ro, Go and Bo has been produced from the modulated brightness components YM having an expanded contrast, they have a contrast that is expanded compared with the first data Ri, Gi and Bi. The second data Ro, Go and Bo produced such that the contrast can be expanded as mentioned above is applied to the timing controller 30.

The control unit 68 generates the second vertical/horizontal synchronizing signals Vsync2 and Hsync2, the second clock signal DCLK2 and the second data enable signal DE2 to be synchronized with the second data Ro, Go and Bo, using the first vertical/horizontal synchronizing signals Vsync1 and Hsync1, the first clock signal DCLK1 and the first data enable signal DE1 inputted from the system 40. Further, the control unit 68 applies the second vertical/horizontal synchronizing signals Vsync2 and Hsync2, the second clock signal DCLK2 and the second data enable signal DE2 to the timing controller 30.

Figure 9:
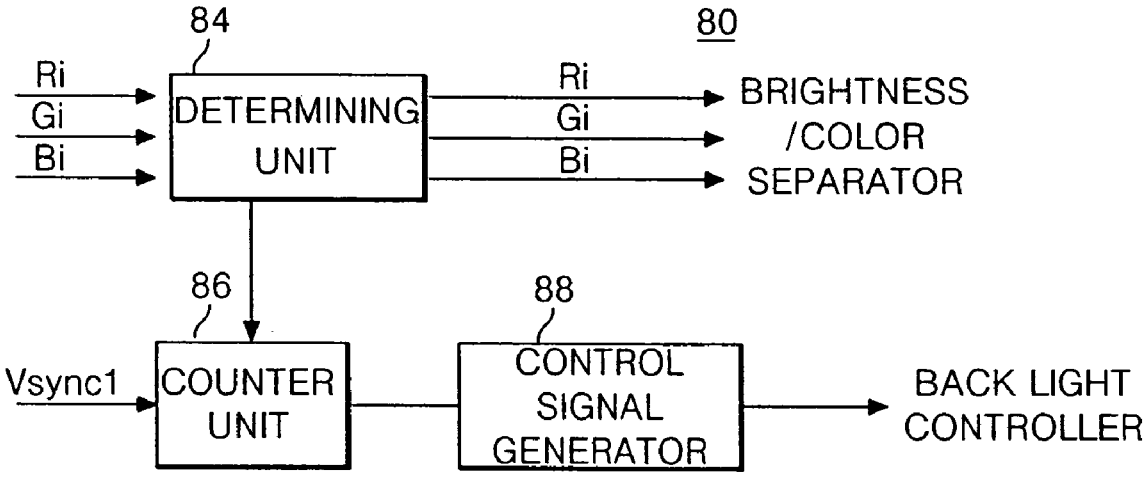
FIG. 9 is a detailed block diagram of the initial color determiner shown in FIG. 8.

The initial color determiner 80 analyzes the gray level values of each of the first data Ri, Gi and Bi inputted from the system 40 for each frame to determine whether or not the current frame is an initial color field. To this end, the initial color determiner 80 includes a determining unit 84, a counting unit 86 and a control signal generator 88 as shown in FIG. 9.

The determining unit 84 determines the gray levels of each of the first data Ri, Gi and Bi inputted from the system 40 to thereby determine whether an initial color is displayed in a particular pixel. Data to be displayed by the pixels is continuously applied to the determining unit 84. Then, the determining unit 84 determines the first data is to display initial colors when only one of red (Ri), green (Gi) and blue (Bi) data has a gray level of 32 or more while the remaining data have gray levels of less than 32 in the pixel. Experimentally, a color having a gray level of less than 32 is almost invisible. Thus, when only one of red (Ri), green (Gi) and blue (Bi) data has a gray level of 32 or more, the determining unit 84 determines the data for this pixel to be data for displaying initial colors.

Figure 10:
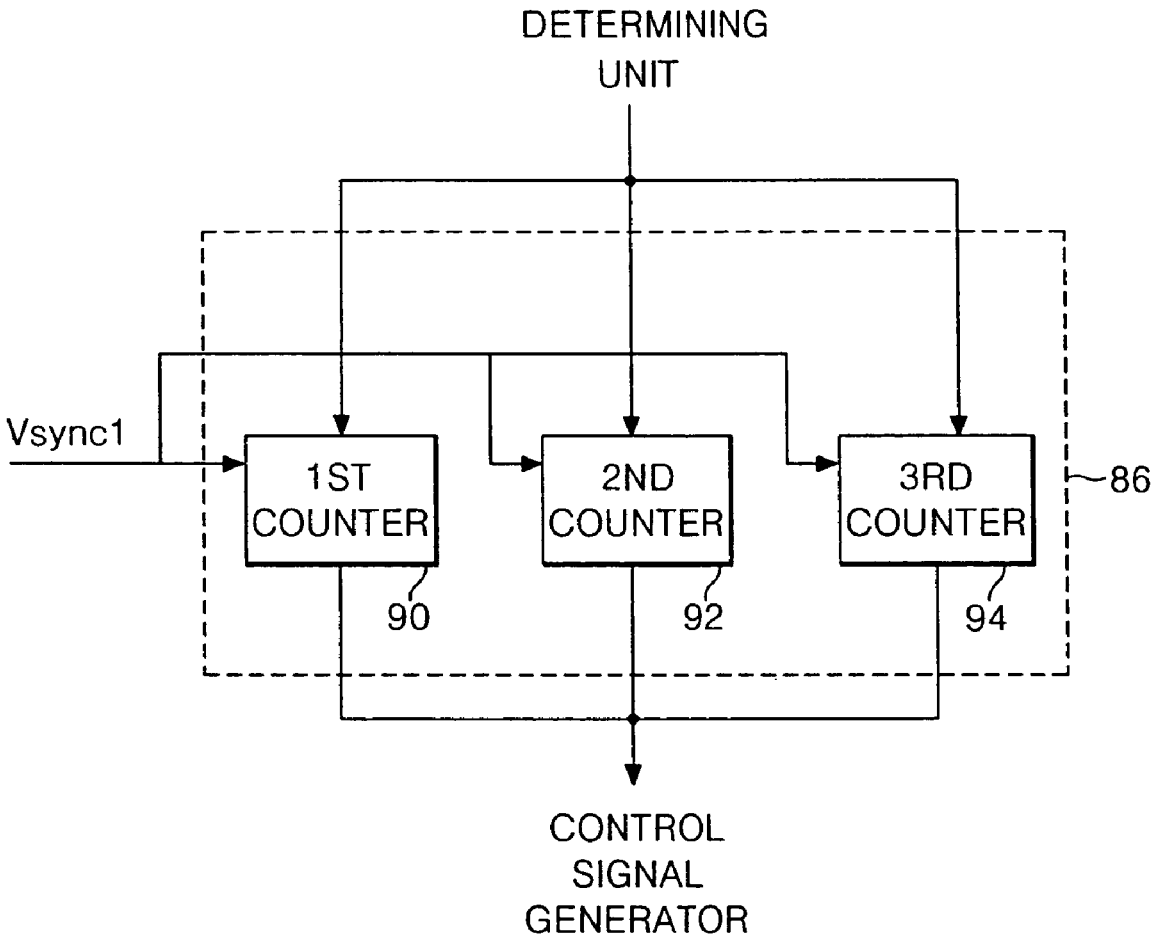
FIG. 10 is a detailed block diagram of the counter part shown in FIG. 9.

If the pixel data is determined to be an initial color, then the determining unit 84 controls the counter unit 86 to increment a value of the counter unit 86 by one. To this end, the counter unit 86 is comprised of three counters 90, 92 and 94 as shown in FIG. 10. The first counter 90 determines data for the current pixel to be an initial color under control of the determining unit 84, and is counted when only the red (Ri) data has a gray level of 32 or more. The second counter 92 determines data for the current pixel to be an initial color under control of the determining unit 84, and is counted (i.e., incremented by one) when only the green (Gi) data has a gray level of 32 or more. The third counter 94 determines data for the current pixel to be an initial color under control of the determining unit 84, and is counted (i.e., incremented by one) when only the blue (Bi) data has a gray level of 32 or more.

The counters 90, 92 and 94 included in the counter unit 84 are counted in correspondence with pixel data for one frame under control of the determining unit 84. Further, the counters 90, 92 and 94 are initialized when the first vertical synchronizing signal Vsync1 is inputted from the system 40. In other words, the counters 90, 92 and 94 are initialized for each frame.

The control signal generator 88 compares counted values of the first, second or third counters 90, 92, 94 with a critical value inputted in advance thereto to thereby generate a control signal. In this case, the control signal generator 88 determines the data to be an initial color field when a value counted by one of the first, second or third counters 90, 92, 94 exceeds the critical value (i.e. the value is greater than the critical value when the counter increments or the value is less than or equal to the critical value if the counter decrements), thereby applying a desired control signal to the back light controller 82.

More specifically, a critical value is stored in the control signal generator 88 in advance. For instance, the critical value can be set to half (½) of the number of pixels in the liquid crystal display panel 22. The critical value is determined by various experiments such that the data is determined to be an initial color field when the counted value exceeds the critical value. The control signal generator 88 in which the critical value has been stored compares a counted value of the first counter 90 with the critical value for each frame to thereby determine whether or not the counted value exceeds the critical value. If the counted value from the first counter 90 has exceeded the critical value, then the control signal generator 88 generates a first control signal and applies it to the back light controller 82.

Similarly, the control signal generator 88 compares the counted value of the second counter 92 with the critical value for each frame to thereby determine whether or not the counted value exceeds the critical value. If the counted value from the second counter 92 has exceeded the critical value, then the control signal generator 88 generates a second control signal and applies it to the back light controller 82. The control signal generator 88 compares a counted value of the third counter 94 with the critical value for each frame to thereby determine whether or not the counted value exceeds the critical value. If the counted value from the third counter 94 has exceeded the critical value, then the control signal generator 88 generates a third control signal and applies it to the back light controller 82.

On the other hand, if counted values from the first, second or third counters 90, 92, 94 are less than the critical value, then the control signal generator 88 does not generate the first, second or third control signals. The first, second and third control signals may be either the same value or different values.

The back light control 100 extracts a control value from the histogram analyzer 56, and generates a brightness control signal Dimming using the extracted control value. The control value adjusts the brightness of the back light 38 and can be, as above, the most-frequent value and/or the average value of the brightness components in the histogram. Further, the back light control 100 generates a brightness control signal Dimming in response to a control signal from the initial color determiner 80.

The back light control 100 includes a control value extractor 60 and a back light controller 82.

The back light controller 82 generates a brightness control signal Dimming such that light of a brightness corresponding to the control value can be supplied when a control signal is not applied from the initial color determiner 80. On the other hand, the back light controller 82 generates a brightness control signal Dimming such that light of a preset brightness can be supplied when a control signal is applied from the initial color determiner 80.

First, an operation procedure of the back light controller 82 will be described in detail assuming that the first to third control signals generated from the control signal generator 88 are the same control signal.

If a control signal is applied from the control signal generator 88 (i.e., an initial color field is displayed), then the back light control 88 generates a brightness control signal Dimming such that light of a brightness more than half of a preset brightness (e.g. maximum brightness) is generated by the back light 38. In other words, the back light controller 82 generates a brightness control signal Dimming such that a high brightness can be supplied, irrespective of a control value from the control value extractor 60, when a control signal is applied from the control signal generator 88.

If a high brightness is applied from the back light 38 to the liquid crystal display panel 22 when a control signal is supplied from the control signal generator 88 as mentioned above, then the color range of the initial color field is restored. In other words, in another embodiment of the present invention, a high brightness is supplied irrespective of the control value when the data is of an initial color field, so that an initial color picture can be sharply displayed without any deterioration of brightness.

Next, an operation procedure of the back light controller 82 will be described in detail assuming that the first to third control signals generated from the control signal generator 88 are different control signals. If first to third control signals are supplied, then the back light controller 82 generates a brightness control signal Dimming such that brightness having more than half of a preset brightness is generated by the back light 38.

In this case, the back light controller 82 generates a predetermined brightness control signal Dimming such that an optimum brightness corresponding to a red color field is supplied when a first control signal (i.e., a red color field) is inputted. The optimum brightness corresponding to the red color field is experimentally determined considering the length, resolution and peripheral environment, etc. of the liquid crystal display panel 22.

Furthermore, the back light controller 82 generates a predetermined brightness control signal Dimming such that an optimum brightness corresponding to a green color field is supplied when a second control signal (i.e., a green color field) is inputted. The optimum brightness of light corresponding to the green color field is experimentally determined in consideration of the length, resolution and peripheral environment, etc. of the liquid crystal display panel 22.

Moreover, the back light controller 82 generates a predetermined brightness control signal Dimming such that an optimum brightness corresponding to a blue color field is supplied when a third control signal (i.e., a blue color field) is inputted. The optimum brightness corresponding to the blue color field is experimentally determined in consideration of the length, resolution and peripheral environment, etc. of the liquid crystal display panel 22.

Accordingly, in another embodiment of the present invention, an optimum brightness of light is supplied, irrespective of the control value of the histogram, when initial color fields are displayed, thereby displaying a sharp picture without any deterioration of brightness in the initial color field.

As described above, according to the present invention, brightness components are extracted from the first data and the second data having an expanded contrast is generated with the aid of the extracted brightness components, thereby displaying a vivid image. Furthermore, brightness of the back light is controlled with the aid of the brightness components extracted from the first data, thereby displaying a vivid image. Moreover, brightness of the back light is controlled such that an optimum picture can be displayed when the data to be displayed is that of an initial color field, thereby displaying a sharp picture without any deterioration of brightness.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a display, comprising:

determining whether data to be displayed is that of an initial color field by receiving red, green and blue data for each frame;

changing a corresponding counted value when only one of the red, green and blue data has a gray level at least a preset amount while the remaining red, green and blue data has a gray level of less than the preset amount;

determining that one of the red, green and blue data to be the initial color field when the corresponding counted value exceeds a predetermined critical value in which the corresponding counted value has been changed; and controlling a back light such that a corresponding predetermined brightness is supplied when the frame data is that of the initial color field.

2. The method of claim 1, wherein the preset amount is 32.

3. The method of claim 1, wherein the predetermined critical value is half of the pixels in the display.

4. The method of claim 1, wherein the corresponding predetermined brightness is more than half of a maximum brightness able to be generated by the back light.

5. The method of claim 4, wherein the corresponding predetermined brightness is the maximum brightness.

6. A method of driving a frame of a display, comprising:

(A) determining whether first data to be displayed for each frame is that of an initial color field;

(B) converting the first data into brightness components and arranging the brightness components into a histogram;

(C) generating second data having an expanded contrast using the histogram;

(D) extracting a control value from the histogram; and (E) controlling brightness of a back light in correspondence with the control value if it is determined that the first data is not that of the initial color field, and controlling the back light to emit a predetermined brightness irrespective of the control value if it is determined that the first data is that of the initial color field.

7. The method of claim 6, wherein (A) comprises:

receiving first red, green and blue data for each pixel in the display;

changing a corresponding counted value of a counter when only one of the first red, green and blue data has a gray level that is at least a preset amount while the remaining red, green and blue data has a gray level of less than the preset amount; and determining one of the first red, green and blue data to be the initial color field when the corresponding counted value exceeds a predetermined critical value in a direction in which the corresponding counted value has been changed.

8. The method of claim 7, wherein the predetermined critical value is half of a number of pixels in the display.

9. The method of claim 7, wherein changing the corresponding counted value comprises:

changing a first counter when only the first red data has a gray lever of at least the preset amount;

changing a second counter when only the first green data has a gray level of at least the preset amount; and changing a third counter when only the first blue data has a gray level of at least the preset amount.

10. The method of claim 9, wherein the preset amount is 32.

11. The method of claim 9, wherein one of the first red, green and blue data is determined to be the initial color field when one of counted values from the first, second or third counters exceeds the critical value.

12. The method of claim 9, wherein, when a counted value from the first counter exceeds the critical value, the back light supplies a first predetermined brightness in correspondence with a red color field.

13. The method of claim 12, wherein the first predetermined brightness is more than half of a maximum brightness able to be generated by the back light.

14. The method of claim 9, wherein, when a counted value from the second counter exceeds the critical value, the back light supplies a second predetermined brightness in correspondence with a green color field.

15. The method of claim 14, wherein the second predetermined brightness is more than half of a maximum brightness able to be generated by the back light.

16. The method of claim 9, wherein, when a counted value from the third counter exceeds the critical value, the back light supplies a third predetermined brightness in correspondence with a blue color field.

17. The method of claim 16, wherein the third predetermined brightness is more than half of a maximum brightness able to be generated by the back light.

18. The method of claim 9, wherein the first, second and third counters are initialized when a vertical synchronizing signal is supplied to an input thereof.

19. The method of claim 6, wherein the preset amount is 32.

20. The method of claim 6, wherein the predetermined brightness is more than half of a maximum brightness able to be generated by the back light.

21. The method of claim 20, wherein the predetermined brightness is the maximum brightness.

22. The method of claim 6, wherein the control value is a most-frequent value or an average value of the histogram.

23. A driving apparatus for a display, comprising:

an initial color determiner that determines whether first data received at an input for each frame is an initial color field;

an image signal modulator that extracts brightness components from the first data, converts the brightness components into a histogram for each frame, and generates second data having an expanded contrast in correspondence with a result extracted from the histogram;

a back light that emits light; and a back light controller that controls brightness of the back light under control of the initial color determiner or the image signal modulator dependent on whether the first data is the initial color field.

24. The driving apparatus of claim 23, wherein the initial color determiner comprises:

a determining unit that determines whether or not first red, green and blue data received for each pixel are that of an initial color field;

a counter unit having at least one counter for changing a value of the counter under control of the determining unit when the first data are determined to be that of the initial color field; and a control signal generator for comparing the changed value from the counter unit with a predetermined critical value to generate a control signal.

25. The driving apparatus of claim 24, wherein the critical value is half of a number of the pixels.

26. The driving apparatus of claim 25, wherein the counter unit comprises:

a first counter that changes a first counted value when only the first red data has a gray level of at least a preset amount;

a second counter that changes a second counted value when only the first green data has a gray level of at least the preset amount; and a third counter that changes a third counted value when only the first blue data has a gray level of least the preset amount.

27. The driving apparatus of claim 26, wherein the preset amount is 32.

28. The driving apparatus of claim 26, wherein the first, second, and third counters are initialized when a vertical synchronizing signal is supplied to an input thereof.

29. The driving apparatus of claim 24, wherein the determining unit determines the first data to be the initial color fields when only one of first red, green and blue data for each pixel has a gray level of that is at least a preset amount.

30. The driving apparatus of claim 29, wherein the preset amount is 32.

31. The driving apparatus of claim 29, wherein the control signal generator generates the control signal when only one of first, second, or third counted values exceeds the critical value.

32. The driving apparatus of claim 31, wherein the back light controller controls the back light such that a predetermined brightness is supplied when the control signal is applied and controls the back light such that light having a brightness corresponding to a control value extracted from the histogram for each frame is supplied otherwise.

33. The driving apparatus of claim 32, wherein the control value is a most-frequent value or an average value of the histogram.

34. The driving apparatus of claim 31, wherein the predetermined brightness is more than half of a maximum brightness able to be generated by the back light.

35. The driving apparatus of claim 34, wherein the predetermined brightness is the maximum brightness.

36. A method of driving a display, the method comprising:

determining whether an image to be displayed on the display for each frame is substantially a single color;

determining a control value from a brightness of the image;

expanding a contrast of the image using the control value;

controlling a back light to emit light of a brightness independent of the control value if the image is substantially the single color and using the control value if the image is not substantially the single color; and displaying the image of expanded contrast using light from the back light.

37. The method of claim 36, further comprising controlling the back light to emit light of a predetermined brightness if the image is substantially the single color.

38. The method of claim 36 further comprising:

receiving red, green and blue data for each pixel in the display;

changing a corresponding counted value when only one of the first red, green and blue data is brighter than a corresponding predetermined brightness; and determining the image is substantially the single color when the corresponding counted value exceeds a predetermined critical value in a direction in which the corresponding counted value has been changed.

39. The method of claim 38, wherein the predetermined critical value is at least half of a number of pixels in the display.

40. The method of claim 38, wherein changing the corresponding counted value comprises:

changing a first counted value when only the red data is greater than a first predetermined value;

changing a second counted value when only the green data is greater than a second predetermined value; and changing a third counted value when only the blue data is greater than a third predetermined value.

41. The method of claim 40, wherein the first, second, and third predetermined values are equal.

42. The method of claim 40, wherein the first, second, and third predetermined values are different.

43. The method of claim 40, wherein determining the image is substantially the single color comprises:

determining the image is substantially red when the first counted value exceeds a first predetermined critical value, the second counted value does not exceed a second predetermined critical value, and the third counted value does not exceed a third predetermined critical value;

determining the image is substantially green when the second counted value exceeds the second predetermined critical value, the first counted value does not exceed the first predetermined critical value, and the third counted value does not exceed the third predetermined critical value; and determining the image is substantially blue when the third counted value exceeds the third predetermined critical value, the first counted value does not exceed the first predetermined critical value, and the second counted value does not exceed the second predetermined critical value.

44. The method of claim 40, wherein the first, second, and third critical values are equal.

45. The method of claim 40, wherein the first, second, and third critical values are different.

46. The method of claim 40, further comprising the back light emitting light of a different brightness dependent on which of the first, second, or third counted values exceeds the first, second, or third predetermined values, respectively.

47. The method of claim 46, wherein each of the different brightnesses is at least half of a maximum brightness able to be generated by the back light.

48. The method of claim 40, further comprising initializing the first, second and third counted values each time a new image is to be displayed.

49. The method of claim 36, wherein the control value is a most-frequent brightness of pixels in the display or an average value of a brightness of the image to be displayed.

* * * * *

UNITED STATES PATENT AND TRADEMARK OFFICE

CERTIFICATE OF CORRECTION

PATENT NO. : 7,443,377 B2
APPLICATION NO. : 10/879868
DATED : October 28, 2008
INVENTOR(S) : Ki Duk Kim It is certified that error appears in the above-identified patent and that said Letters Patent is hereby corrected as shown below:

In the Claims

Column 13, claim 26, line 10, after "gray level of" insert --at--.

Column 13, claim 29, line 20, after "pixel has a gray level" delete "of".

Column 13, claim 31, line 25, before "first, second, or third" insert --the--.

Column 13, claim 38, line 55, immediately after "method of claim 36" insert --,-- (comma).

Signed and Sealed this

Twenty-eighth Day of July, 2009

John Doll

JOHN DOLL
*Acting Director of the United States Patent and Trademark Office*